United States Patent [19]

Ziemba

[11] 3,951,040

[45] Apr. 20, 1976

[54] AMMUNITION PROJECTILE

[75] Inventor: Richard T. Ziemba, Burlington, Vt.

[73] Assignee: General Electric Company, Burlington, Vt.

[22] Filed: July 9, 1973

[21] Appl. No.: 379,514

Related U.S. Application Data

[63] Continuation of Ser. No. 63,688, Aug. 14, 1970, abandoned.

[52] U.S. Cl. ..... 89/14 R; 86/1 R; 102/38; 102/92.4

[51] Int. Cl.[2] ..... F41F 17/10; F42B 13/50

[58] Field of Search ..... 42/1, 76 R, 78; 89/14 R; 102/38, 39, 67, 69, 92.1, 92.4, 92.6, 92.7, 93

[56] References Cited

UNITED STATES PATENTS 39,024 6/1863 Allen ..... 42/78

1,650,908 11/1927 Ramsey ..... 42/1 R

FOREIGN PATENTS OR APPLICATIONS 25,030 1906 United Kingdom ..... 89/14 R

*Primary Examiner*—Stephen C. Bentley

[57] ABSTRACT

A projectile for a round of ammunition is provided comprising a frangible stack of serrated metal discs with an integral rotating band. The rifled barrel of the gun imparts a high spin rate to the discs which gives them dynamic stability in flight. Acceleration along the gun barrel separates the discs. The discs are effective throughout their entire air borne range, as a result of their spin energy in addition to their forward velocity at target impact. The serrated edges of the spinning discs are capable of producing severe flesh wounds even at low strike velocities.

17 Claims, 10 Drawing Figures

INVENTOR:
RICHARD T. ZIEMBA,

BY
HIS ATTORNEY.

INVENTOR:
RICHARD T. ZIEMBA,

BY
HIS ATTORNEY.

INVENTOR:
RICHARD T. ZIEMBA,

BY
HIS ATTORNEY.

INVENTOR:
RICHARD T. ZIEMBA,

BY
HIS ATTORNEY.

AMMUNITION PROJECTILE

This application is a continuation of Ser. No. 63,688, filed Aug. 14, 1970, now abandoned.

BACKGROUND OF THE INVENTION

1. Field of Invention

This invention relates to projectiles for ammunition, especially to a multipart, separable projectile of antipersonnel utility.

2. Prior Art

Effective close-in support of men and material is a mandatory requirement for modern gun systems. Recent advances in medium caliber, i.e., 20 to 30mm ammunition designs have brought about significant improvements towards this end. For instance, controlled fragmentation high explosive rounds, and multiple flechette rounds have greatly increased the survivability of the modern armed vehicle against ambush. However, these munitions have their limitations. The controlled fragmentation HE round or an air burst, cased shrapnel round, such as are respectively shown for example in U.S. Pat. No. 2,401,483 issued June 4, 1946, and U.S. Pat. No. 1,244,046 issued Oct. 23, 1916, have no capability at very close ranges; and the multiple-flechette round such as is shown in U.S. Pat. No. 3,412,681 issued Nov. 26, 1968, has very limited effectiveness at extended ranges.

SUMMARY OF THE INVENTION

It is an object of this invention to provide an antipersonnel round which is effective over a wide range starting from the gun muzzle.

A feature of this invention is the provision of a projectile comprising a frangible stack of serrated metal discs with an integral rotating band. The rifled barrel imparts a high spin rate to the discs which gives them dynamic stability in flight. Acceleration along the gun barrel separates the discs. The discs are effective throughout their entire air borne range, as a result of their spin energy in addition to their forward velocity at target impact. The serrated edges of the spinning discs are capable of producing severe flesh wounds even at low strike velocities.

BRIEF DESCRIPTION OF THE DRAWING

This and other objects, features and advantages of the invention will be apparent from the following specification taken in conjunction with the accompanying drawing in which.

FIRST EMBODIMENT

Figure 1A:
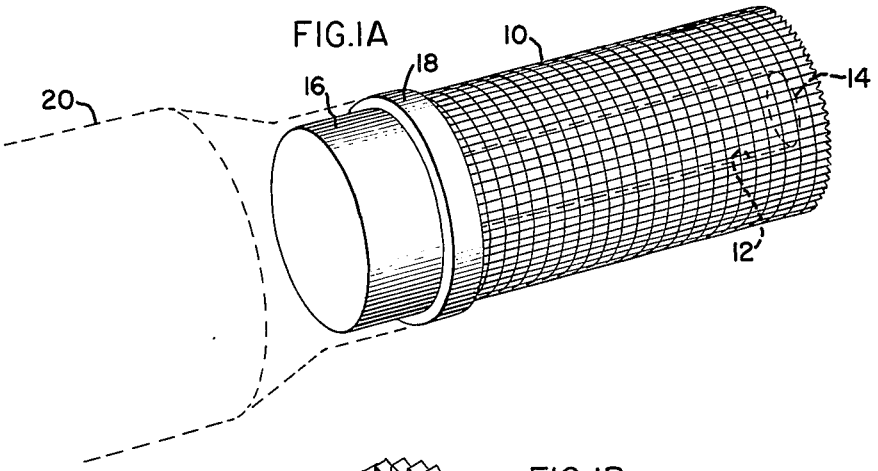
FIG. 1A is a perspective view of a projectile serving as a first embodiment of this invention.
Figure 1B:
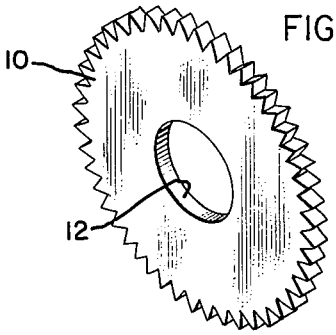
FIG. 1B is a perspective view of a constituent disc of the projectile of FIG. 1A.
Figure 2A:
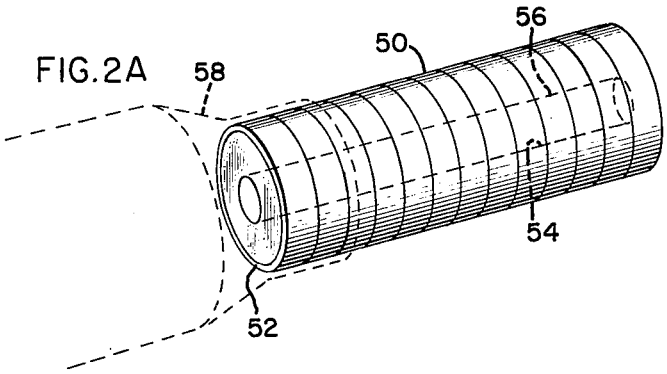
FIG. 2A is a perspective view of a projectile serving as a first embodiment of this invention.
Figure 2B:
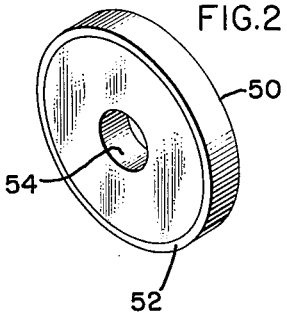
FIG. 2B is a perspective view of a constituent disc of the projectile of FIG. 2A.

The antipersonnel round comprises a stack of serrated edge discs 10, each having a central longitudinal hole 12, fixed on a frangible rod 14, which rod is fixed onto a base 16 having a rotating band 18, which is crimped into a conventional cartridge case 20, to be fired in a conventional rifled gun barrel. The rifled barrel imparts a high spin rate to the assembly. The rod is made of a frangible material such as glass or plastic which disintegrates upon acceleration of the assembly along the barrel.

SECOND EMBODIMENT

The antipersonnel round comprises a stack of discs 50, each having an outer annulus 52 of a readily engraved material, such as copper alloy, and a central longitudinal hole 54 fixed on a frangible rod 56, the aft portion of the stack being crimped into a conventional cartridge case 58, to be fired in a conventional rifled gun barrel. When the round is fired, each of the discs engages the gun barrel as it passes along the barrel has serrations engraved into its outer annulus by the barrel rifling. Gain twist rifling insures the separation of the discs as they pass along the gun barrel.

Alternatively, in lieu of the frangible rod, the discs may be held together by an adhesive or other bond, or by a soft metal rivet. The entire projectile of the first embodiment may be fabricated of discs, with all of the discs pre-serrated except those serving as the rotating band which would be fabricated with an outer annulus of copper alloy.

DYNAMICS

The full effectiveness of this antipersonnel projectile is realized through a combination of the high strike velocity and the high spin rate of the impacting discs. The strike velocity of the discs is a function of the initial muzzle velocity of the projectile and the disc velocity decay due to aerodynamic drag. The spin of the discs is a function of the projectile muzzle velocity, the exit angle of the rifled bore and the spin decay of the discs through their trajectory.

Figure 3:
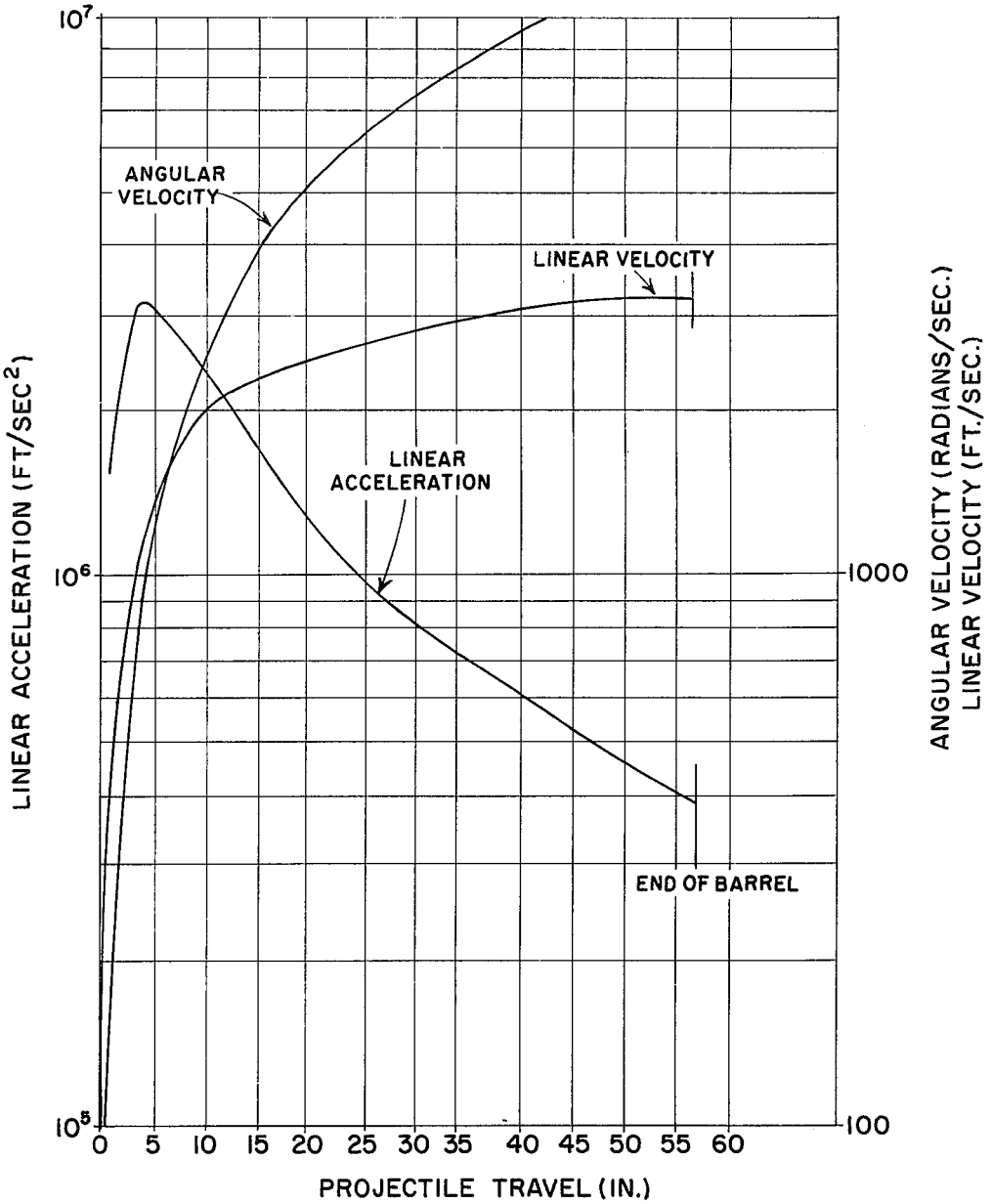
FIG. 3 is a plot of the interior ballistics of a projectile embodying this invention.

The interior ballistics plot of a typical 20mm disc projectile is shown in FIG. 3. The resultant muzzle velocity is a function of projectile weight, propellant charge, propellant impetus and barrel length. For conventional projectiles, the spin rate would be determined simply by the exit angle of the barrel rifling and the projectile muzzle velocity. For a disc projectile of the type described in the First Embodiment this is not necessarily the case, since the individual discs are free to rotate independently of each other and the rotating band driver. The discs assume an edge-on attitude shortly after emerging from the muzzle in a flat-on attitude.

Figure 4:
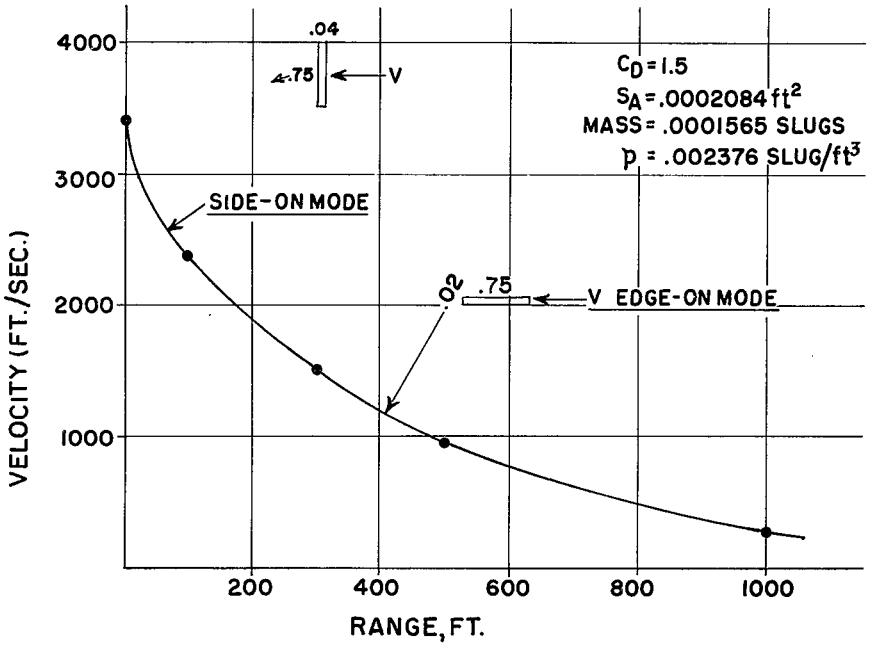
FIG. 4 is a plot of velocity vs. range for 20mm constituent discs.
Figure 5:
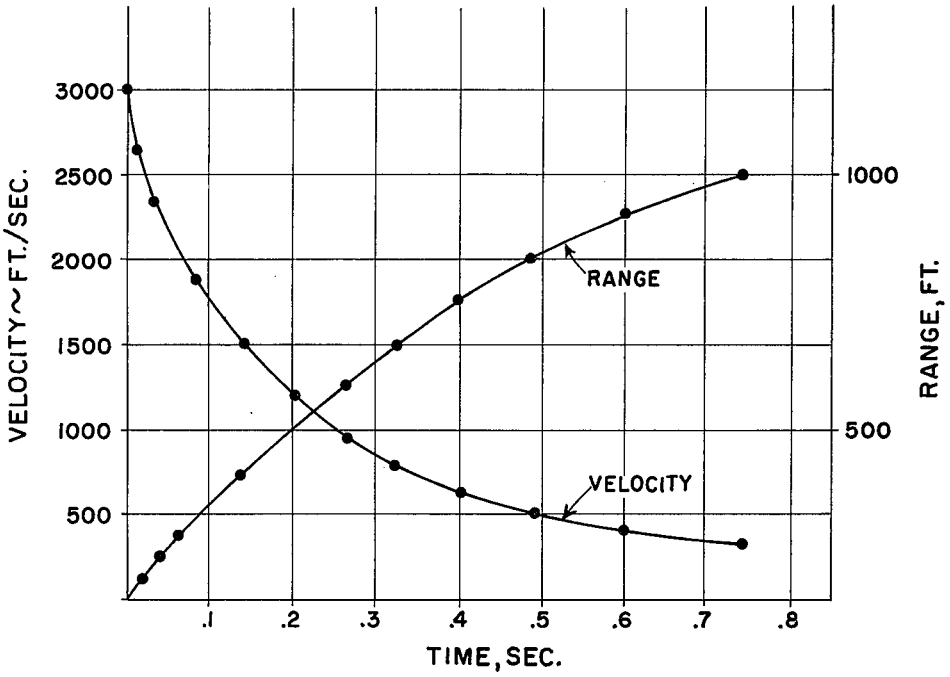
FIG. 5 is a plot of range and velocity vs. time for 20mm constituent discs.

FIG. 4 is a plot of the velocity decay of 0.75 inch by 0.040 inch disc having an initial velocity of 3,380 feet/-second. This disc is assumed to have traveled the first ten meters in a flat-on attitude before it oriented to the edge-on attitude which it retained throughout the remainder of its flight. FIG. 5 shows the time of flight as a function of range and velocity for the same disc configuration.

Much like a flechette, the disc is able to penetrate light metal and wood target materials when its forward velocity is high. Different from the flechette, however, the disc is still capable of inflicting severe wound damage even when its forward velocity is low, because of the energy it stores in spin.

Figure 6:
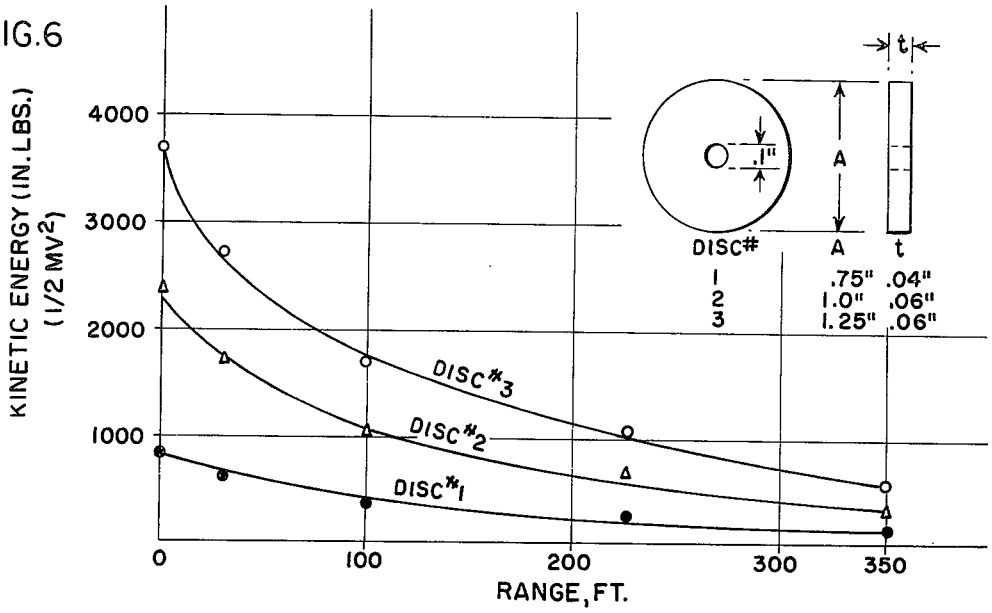
FIG. 6 is a plot of kinetic energy due to strike velocity vs. range for a variety of constituent discs.
Figure 7:
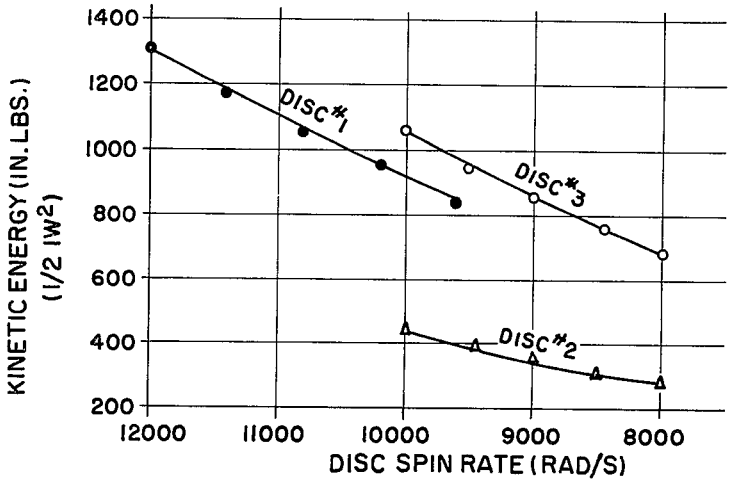
FIG. 7 is a plot of kinetic energy due to angular velocity vs. spin rate of the discs of FIG. 6.
Figure 8:
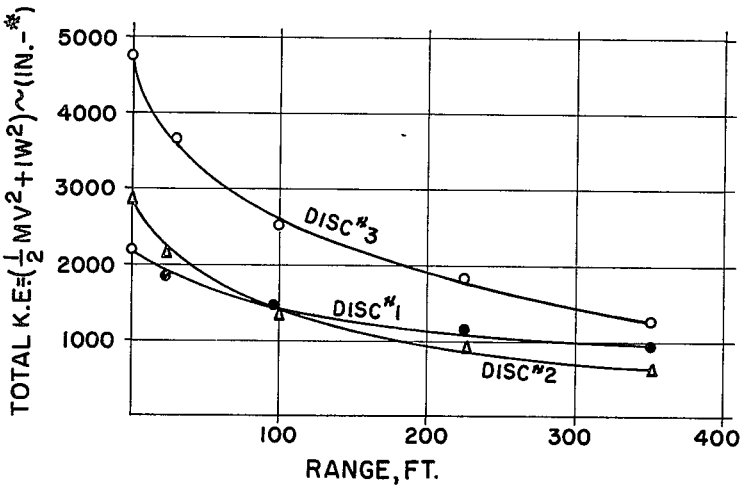
FIG. 8 is a plot of total kinetic energy vs. range of the discs of FIG. 6.

Near the gun muzzle, the forward velocity of the discs is high in relation to its rotational velocity. In fact, the disc makes only two revolutions in 3 feet of travel. At this relatively low spin rate, target penetration is primarily the result of the disc's strike velocity, not its rotational velocity. As the forward velocity of the disc decays, however, the rotational velocity of the disc becomes the contributing factor to wound damage. This energy relationship is shown in FIGS. 6, 7, and 8. FIG. 6 is a plot of strike energy due to the discs forward velocity only, and FIG. 7 shows the energy attributible to the disc's spin, assuming a 20% loss of spin rate from the gun muzzle to the range limit of the discs. The total energy within the discs from both velocity and spin is plotted in FIG. 8 as a function of range. It can be seen that the 20mm disc has more total energy at extended ranges than the 25mm disc even though the 25mm disc is larger. This is due to the fact that the 20mm disc had a larger initial spin rate than the 25mm disc and it remained higher throughout its flight.

It is interesting to note that the spin energy within the 20mm disc, for instance, is nearly ten times as great as its strike energy at a 350 foot range. A spinning body can serve as an effective kill mechanism when energy can be extracted from the device in a short period of time.

The spinning discs are very effective against soft targets even at low strike velocities. In fact, the discs due to their skipping action, tend to seek out soft targets in which to embed themselves.

What is claimed is:

1. A weapon system comprising:
a gun including
a barrel having a bore with a twist rifling groove; and
a round of ammunition including
a cartridge case, and
a projectile carried by and projecting from said case, said projectile including
a plurality of substantially flat disks, each of said disks having an outer annulus with an outside diameter substantially equal to the diameter of said rifling groove, providing a characteristic of operation whereby said outer annulus is engaged, engraved and rotationally accelerated by said rifling during passage of said projectile through said bore of said gun barrel, and
frangible bond means securing said disks together in a cohesive, frangible stack;
whereby during passage of said projectile through said bore the acceleration provided by said twist rifling disintegrates said frangible bond means and separates each of said disks from the others.

2. A system according to claim 1 wherein:
said frangible bond means comprises a rod, disposed longitudinally of said stack and fixed centrally to each of said disks, and made of a relatively frangible material which will disintegrate upon the acceleration provided by said rifling.

3. A system according to claim 1 wherein:
said frangible bond means comprises an adhesive material disposed between each of said disks, and made of a relatively frangible material which will disintegrate upon the acceleration provided by said rifling.

4. A system according to claim 1 wherein:
said twist rifling is gain twist rifling.

5. A weapon system comprising:
a gun including
a barrel having a bore with a twist rifling groove; and
a round of ammunition including
a cartridge case, and
a projectile including
a base disk having a rotating band for engagement by said rifling and carried by and projecting from said case,
a plurality of substantially flat disks, each of said disks having a plurality of peripheral outwardly projecting teeth,
frangible bond means securing said toothed disks together in a stack to said base disk,
whereby during passage of said projectile through said bore, said rifling provides acceleration of said projectile, which acceleration disintegrates said frangible bond means and separates each of said disks from the others.

6. A system according to claim 5 wherein:
said frangible bond means comprises a rod, disposed longitudinally of said stack and fixed centrally to each of said toothed disks and said base disk, and made of a relatively frangible material which will disintegrate upon the acceleration provided by said rifling.

7. A system according to claim 5 wherein:
said frangible bond means comprises an adhesive material disposed between each of said toothed disks and said base disk, and made of a relatively frangible material which will disintegrate upon the acceleration provided by said rifling.

8. A system according to claim 5 wherein:
said twist rifling is gain twist rifling.

9. A round of ammunition, for a gun having a bore with a twist rifling groove, said round comprising:
a cartridge case, and
a projectile carried by and projecting from said case, said projectile including
a plurality of substantially flat disks, each of said disks having an outer annulus with an outside diameter substantially equal to the diameter of the rifling groove, providing a characteristic of operation whereby said outer annulus will be engaged, engraved and rotationally accelerated by the rifling during passage of said projectile through the bore, and
frangible bond means securing said disks together in a cohesive, frangible stack;
whereby during passage of said projectile through the bore, the acceleration provided by the rifling will disintegrate said frangible bond means and separate each of said disks from the others.

10. A system according to claim 9 wherein:
said frangible bond means comprises a rod, disposed longitudinally of said stack and fixed centrally to each of said discs, and made of a relatively frangible material which will disintegrate upon the acceleration provided by the rifling.

11. A system according to claim 9 wherein:
said frangible bond means comprises an adhesive material disposed between each of said disks, and made of a relatively frangible material which will disintegrate upon the acceleration provided by the rifling.

12. A round of ammunition, for a gun having a bore with a twist rifling groove, said round comprising:

a cartridge case, and a projectile including a base disk having a rotating band for engagement by the rifling and carried by and projecting from said case, a plurality of substantially flat disks, each of said disks having a plurality of peripheral, outwardly projecting teeth, frangible bond means securing said toothed disks together as a stack to said base disk, whereby during passage of said projectile through the bore, the acceleration provided by the rifling will disintegrate said frangible bond means and separate each of said disks from the others.

13. A system according to claim 12 wherein:

said frangible bond means comprises a rod, disposed longitudinally of said stack and fixed centrally to each of said disks, and made of a relatively frangible material which will disintegrate upon the acceleration provided by the rifling.

14. A system according to claim 12 wherein:

said frangible bond means comprises an adhesive material disposed between each of said disks, and made of a relatively frangible material which will disintegrate upon the acceleration provided by the rifling.

15. A process of manufacturing and projecting anti-personnel projectiles comprising:

fixing together a plurality of common diameter disks into a cohesive, frangible stack; and accelerating said stack of disks through a twist rifled gun barrel to contemporaneously provide each disk with forward and rotational velocities, engrave outwardly projecting teeth on the outer annulus of each disk, and separate each disk from the others while in said barrel.

16. A process of manufacturing and projecting anti-personnel projectiles comprising:

fixing together a plurality of common diameter disks into a cohesive, frangible stack;

accelerating said stack of disks along a path through and out of a twist rifled gun barrel to contemporaneously accelerate each disk longitudinally along said path, separate each disk from the others while in the barrel, and accelerate each disk rotationally about its own longitudinal axis, which axis initially, while said disk is within the barrel, is substantially parallel to said path, and subsequently, after said disk has left the barrel, is substantially perpendicular to said path.

17. A process according to claim 16 further including engaging each of said disks with the rifling in the barrel, whereby each of said disks is individually engaged, engraved, and constrained by the rifling.

* * * * *